United States Patent [19]

Knickerbocker

[11] 4,426,025

[45] Jan. 17, 1984

[54] CONTINUOUS SPRAY OVERCAP

[75] Inventor: Michael G. Knickerbocker, Crystal Lake, Ill.

[73] Assignee: Seaquist Valve Co., Cary, Ill.

[21] Appl. No.: 296,800

[22] Filed: Aug. 27, 1981

Related U.S. Application Data

[63] Continuation of Ser. No. 50,794, Jun. 21, 1979, abandoned.

[51] Int. Cl.[3] ..... B65D 82/14

[52] U.S. Cl. ..... 222/182; 222/402.14

[58] Field of Search ..... 222/179.5, 182, 402.13, 222/402.14

[56] References Cited

U.S. PATENT DOCUMENTS

| | | | |
|---|---|---|---|
| 2,707,968 | 5/1955 | Efford | 222/108 X |
| 3,765,573 | 10/1973 | Landsman | 222/402.14 X |
| 3,935,974 | 2/1976 | Weyn | 222/402.13 |
| 4,195,756 | 4/1980 | Campbell | 222/182 |

*Primary Examiner*—Joseph J. Rolla
*Assistant Examiner*—Frederick R. Handren
*Attorney, Agent, or Firm*—Frijouf, Rust & Pyle

[57] ABSTRACT

A continuous spray overcap assembly of the type primarily used in conjunction with an aerosol dispenser. The overcap has a substantially cup-shaped body and may be mounted on the rims at the top of an aerosol can thereby protecting the valve from accidental actuation during shipment and shelf storage. In use, the overcap is inverted and remounted onto the aerosol dispenser. A valve actuation device disposed in the base of the overcap opens the valve to continuously dispense product until the overcap is removed from the aerosol dispenser.

3 Claims, 13 Drawing Figures

FIG. 1
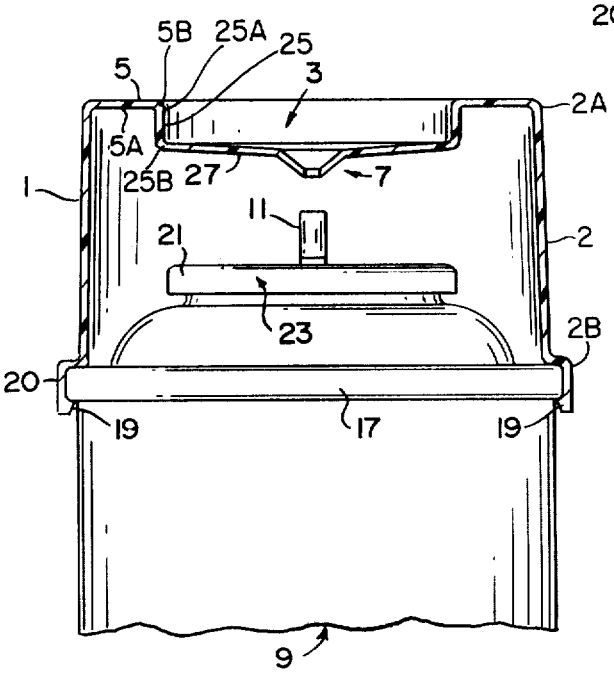
FIG. 2
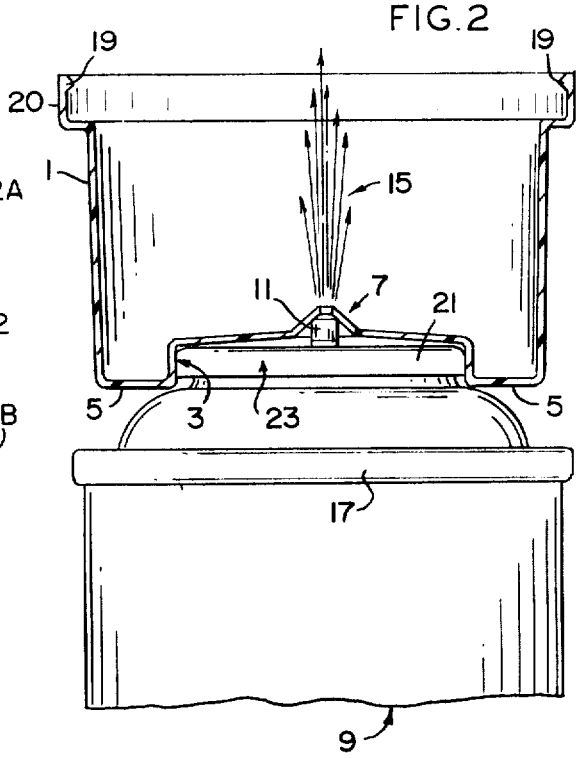
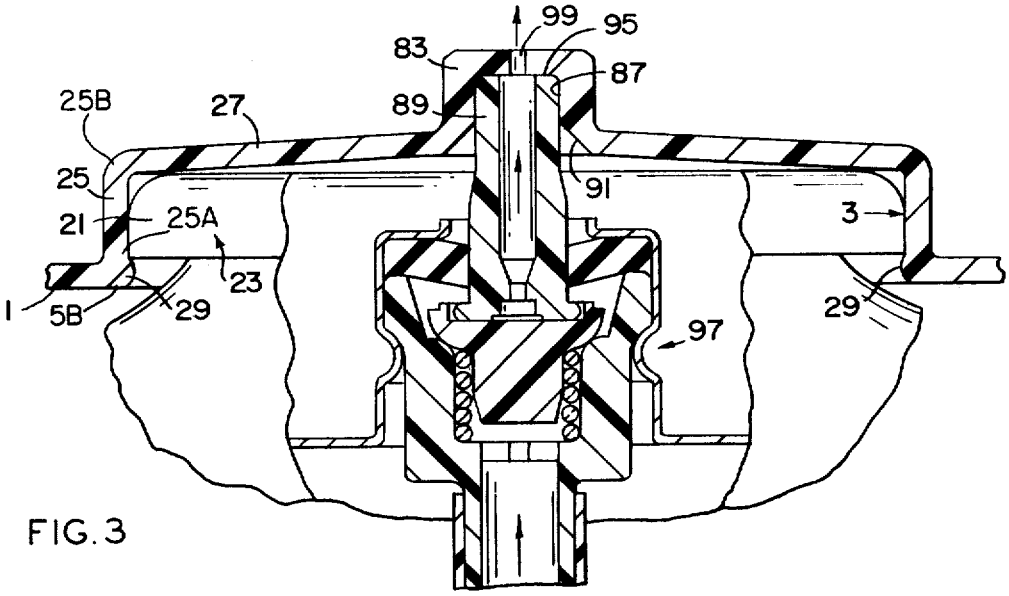
FIG. 3
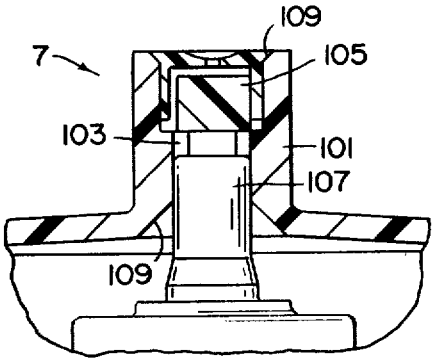
FIG. 8

FIG. 9
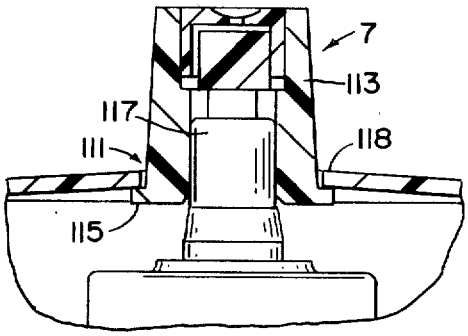
FIG. 5
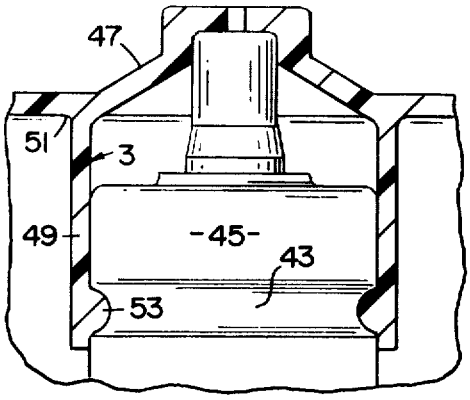
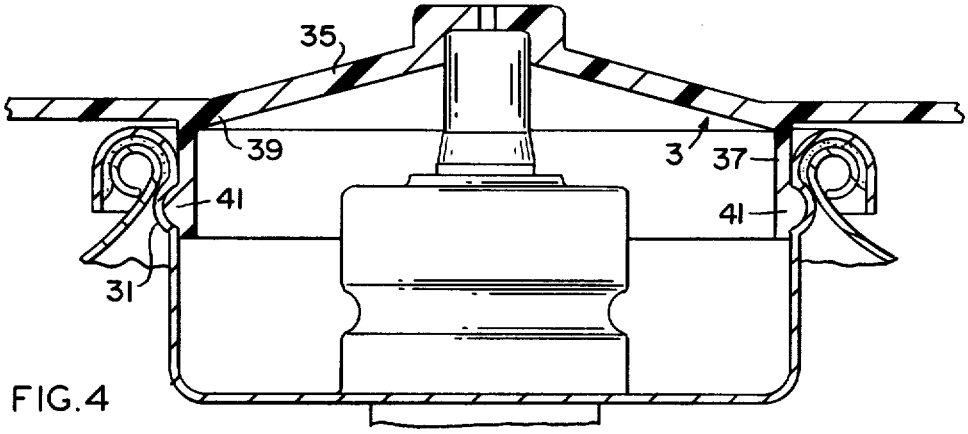
FIG. 4
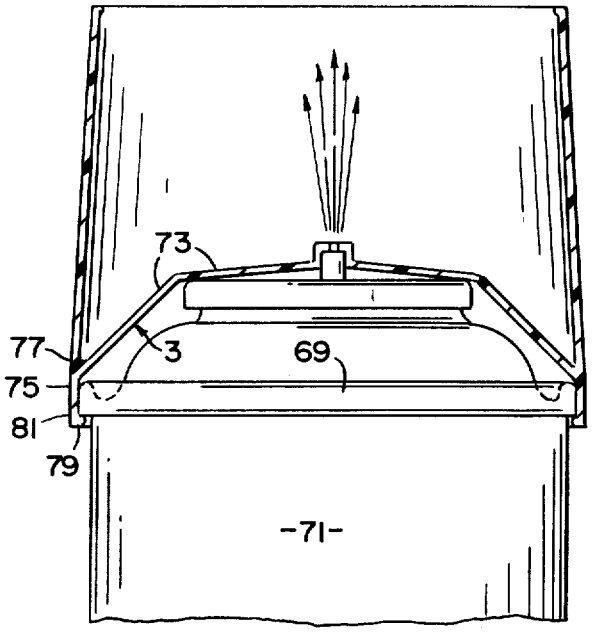
FIG. 7

FIG. 6
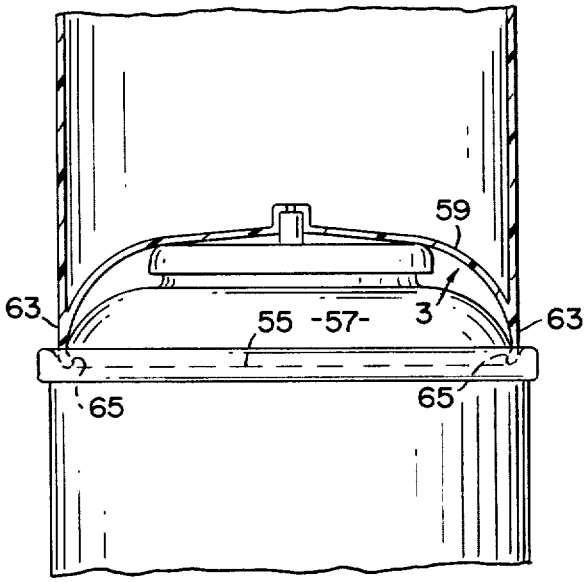
FIG. 10
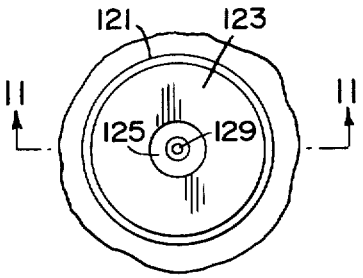
FIG. 11
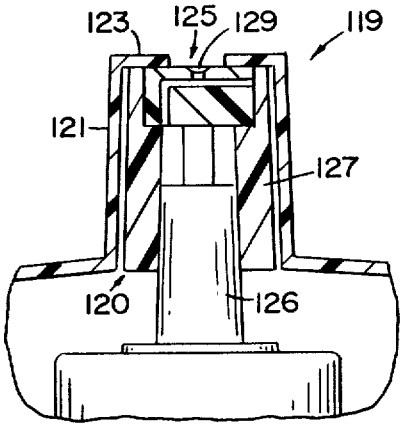
FIG. 12
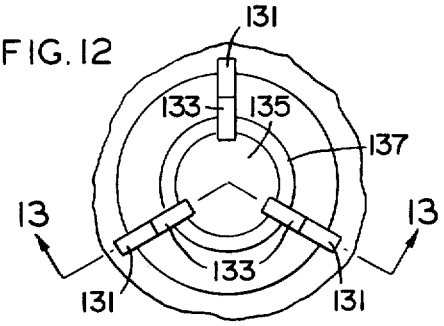
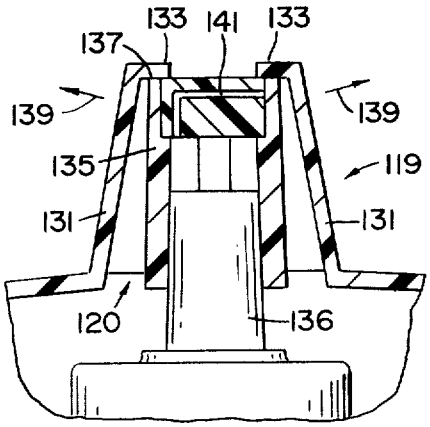
FIG. 13

CONTINUOUS SPRAY OVERCAP

This is a continuation of application Ser. No. 050,794 filed June 21, 1979, now abandoned.

BACKGROUND OF THE INVENTION

1. Field of the Invention

This invention relates to a continuous spray overcap assembly of the type primarily used in conjunction with an aerosol dispenser. More particularly, this invention comprises a cup-shaped continuous spray overcap assembly with a valve actuation means disposed in the base of the cup. When the overcap is inverted and remounted onto the aerosol dispenser, the valve assembly is actuated to continuously dispense the product of the aerosol dispenser.

2. Description of the Prior Art

Presently there exist many different types of aerosol dispensers with various types of valve assemblies. Some assemblies are of the continuous and are primarily designed to remain in an "On" position once dispensing type actuated. Typically, room deodorants and insecticides use such valve assemblies.

One prior art continuous spray assembly consists of an extra-long, closed end valve stem. The body of the stem has scored or crimped indentations. To actuate the valve, the stem is bent back and forth at the indentation until the stem breaks off to allow all of the product and propellant to escape. The major disadvantage of this type of continuous spray assembly is the inability to terminate spraying once the stem has been broken off. This disadvantage can be particularly hazardous if the stem is accidentally broken off during shipment or storage. Another disadvantage is the inability to create a desired spray pattern by the severed stem.

Another type of continuous spray button assembly consists of a clip which, after actuation of a tilt valve, holds the stem in a tilted position. The clip is placed over the button and clips onto a rim of the aerosol dispenser. A hole within the clip allows the product and propellant to be dispensed through the terminal orifice of the button. Unfortunately however, the clip cannot be easily dislodged from the rim. A further disadvantage of this continuous spray button assembly is a two-piece structure. The clip is usually loosely contained within an overcap of the aerosol dispenser. It is therefore possible that the clip will be lost, especially when displayed and subjected to customer handling.

Another type of continuous spray assembly consists of a button mounted upon a tilt valve type assembly. The stem of the assembly has an integral protruding arm. The protruding arm has a hooked portion at the outer end. As the button is tilted to the "On" position, the hook portion engages a rim of the aerosol dispenser. An upstanding tab is integrally molded onto the protruding arm. When the tab is pressed, the tab unhooks the hook portion of the protruding arm, thereby releasing the button. The button then returns to the normal vertical "Off" position. It should be evident that this structure is complicated and expensive and has similar problems as the previously described continuous spray button assemblies.

Another type of continuous spray assembly is an actuation cap shown in U.S. Pat. No. 3,765,573. The actuation cap comprises a cylindrical sidewall with a transverse wall extending therebetween. The transverse wall has a conical protuberance with the vertical axis thereof being offset from the vertical axis of the valve stem. The actuation cap is inverted and is seated on the rim of the mounting cup. This causes the protuberance to actuate the valve stem by tilting the valve stem into an "On" position. The product and propellant are then dispensed through an opening in the apex of the protuberance. The major disadvantage of this type of continuous spray assembly is the configuration of the protuberance. The valve stem does not fit into the protuberance, but rather is only tilted by the protuberance. This lack of fit occasionally causes the product and propellant to impinge onto the interior of the protuberance and hence cause leakage around the valve stem. Furthermore, the product builds up in the opening and under the transverse wall. This is most undesirable since the buildup will interfere with proper issuance of the product. Furthermore, clogging may occur which renders the aerosol dispenser inoperable. Another major disadvantage is the inability to easily incorporate various swirl chambers, expansion chambers and terminal orifices within the structure.

Therefore, in order to overcome the inherent and particular inadequacies of the prior art, it is an object of this invention to provide a continuous spray overcap assembly which may be easily actuated and deactuated.

Another object of this invention is to provide a means to prevent leakage of the product before the product issues from the terminal orifice.

Still another object of this invention is to provide a structure which may utilize various swirl chambers, expansion chambers, inserts and terminal orifices easily incorporated therein to achieve the desired spray pattern.

A further object of this invention is to provide a structure which may be used with a large variety of existing aerosol dispensers.

A still further object of this invention is to provide a structure which is easy to manufacture.

Other objects and a fuller understanding of the invention may be had by referring to the summary of the invention, the description and the claims, taken in conjunction with the accompanying drawings.

SUMMARY OF THE INVENTION

The subject invention relates to a continuous spray overcap assembly of the type primarily used with aerosol dispensers or cans.

The invention functions as a standard protective overcap for the aerosol can during shipment and shelf storage. In use, the overcap assembly is inverted and is mounted onto a rim on the top of the aerosol can. This locks the valve stem in an "On" position, thereby dispensing the product and propellant. Removal of the overcap assembly causes the stem to return to the "Off" position. The overcap assembly can then be reinverted and fitted onto the rim of the can of the aerosol dispenser for further shelf storage. It should be evident that all or only a portion of the product and propellant may be dispensed from the novel continuous spray assembly.

In the preferred embodiment of this invention, the overcap assembly has a cup-shape. A valve actuation means is disposed in the base of the cup-shaped cavity. The rim of the cavity is configured to be resiliently mounted onto a rim of the aerosol dispenser, such as the mounting cup rim, a rim on the chime or the outer rim of the aerosol can. The inside rim of the mounting cup, an undercut on the chime, or the inside rim of the can also can be used for mounting. A plurality of lugs or an annular lip may be utilized to hold the overcap assembly in an inverted valve actuating mounted position.

In a first embodiment, the valve actuation means comprises a nipple for receiving the stem of the aerosol valve. Thus, as the inverted overcap assembly is being mounted, the valve is simultaneously being depressed to actuate the valve.

In a second embodiment, the valve actuation means has the nipple structure of the first embodiment. A terminal orifice insert is fitted into a hole of the nipple. Any type of insert may be utilized depending on the desired spray pattern.

In a third embodiment, the valve actuation means comprises an aperture which encircles the valve button of the aerosol valve. The button may be rigidly press-fitted onto the valve stem or may be an integral valve button with depending stem. The lower portion of the button has an outer annular step. When the overcap assembly is inverted and mounted on the aerosol can, the button fits through the aperture. The edge of the aperture seats on the top of the step to depress the button to activate the valve.

In some circumstances, it is not economical to manufacture a valve button with an annular step. Accordingly, in a fourth embodiment, the valve actuation means has a hollow cage with a top. A standard valve button fits into the cage. The top of the cage depresses the button, thereby actuating the valve.

Alternatively, the cage may simply be at least one upstanding arm. A hand of the arm depresses the button as the overcap is mounted on the aerosol container. A desirable feature of this embodiment is that the arm may be made to flex outwardly, enabling buttons of various diameters to be used with the invention.

A major feature of this invention is the ability to be actuated and deactuated at the convenience of the operator. For example, when a large portion of product must be dispensed, it may be desirable to spray for a rather lengthy period. Ordinarily, the user would be fatigued by the continued depression of the button. For example, bug defoggers, household deodorants, paint sprayers or rug cleaners frequently require such lengthy spray application. A totally continuous spray until exhaustion may be also desired such as in a bug fumigator.

Another feature of this invention is the elimination of buildup of product as the product issues from the terminal orifice. Specifically, in the first and second embodiments of the actuation means, the cavity of the nipple is specially configured to graspingly receive the valve stem. Hence, the nipple preclude leakage of product before the product issues from the nipple. The continued use of a valve button in the third and fourth embodiments inherently precludes leakage.

Another feature of this invention is the ability to achieve almost any type of spray pattern. Specifically, the valve actuation means may include various swirl chambers or expansion chambers prior to the terminal orifice. Various type spray patterns may be achieved including mechanically atomizing the product before dispensing through the use of a mechanical breakup (MBU) insert.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the present invention, reference should be had to the following detailed description taken in connection with the accompanying drawings in which:

FIG. 1 is a cross-sectional view of the continuous spray overcap assembly in a valve protecting position, FIG. 2 is a cross-sectional view of the continuous spray overcap assembly in an inverted spray actuating position;

FIG. 3 is a detailed cross-sectional view of the first embodiment of the valve actuating means;

FIG. 4 is a detailed cross-sectional view of the second embodiment of the valve actuating means;

FIG. 5 is a detailed cross-sectional view of the third embodiment of the valve actuating means;

FIG. 6 is a detailed cross-sectional view of the fourth embodiment of the valve actuating means;

FIG. 7 is a detailed cross-sectional view of the fifth embodiment of the valve actuating means;

FIG. 8 is an enlarged cross-sectional view of the second embodiment of valve actuation means with an insert shown therein;

FIG. 9 is an enlarged cross-sectional view of the third embodiment of valve actuation means with a button and insert shown therein;

FIG. 10 is a top view of the fourth embodiment shown in FIG. 6 illustrating a cage disposed about a standard valve stem.

FIG. 11 is a cross-sectional view taken along lines 11—11 of FIG. 10 showing the cylindrical wall of the cage;

FIG. 12 is a top view of another embodiment of the cage structure showing upstanding arms; and FIG. 13 is a cross-sectional view taken along lines 13—13 of FIG. 12 showing hand of each arm depressing the top of a valve button.

Similar reference characters refer to similar parts throughout the several views of the drawings.

DETAILED DESCRIPTION

As generally shown in FIGS. 1 and 2, this invention is a continuous spray overcap assembly including an overcap having a one-piece cup-shaped cylindrical overcap body 1. The overcap body 1 has integral sidewalls 2 extending between a first end 2A and a second end 2B. A first cylindrical recess or cavity 3 is defined in the base 5. The overcap base 5 extends inwardly from the first end 2A of sidewall 2 forming an outer annular base portion 5A terminating at an inner edge 5B. An inner cylindrical sidewall 25 has a first and a second end 25A and 25B and is disposed parallel to the sidewall 2. The first end 25A of the inner sidewall 25 is integrally attached to the inner edge 5B of the annular portion 5A with the second end 25B extending toward the second end 2B of the overcap 1. An inner base portion of conical top 27 is disposed generally parallel to the outer annular portion 5A and integrally extending from the second end 27B of the inner cylindrical sidewall 25 defining a first cylindrical recess or cavity 3 coaxial with the overcap body 1. The first recess 3 has a sidewall height between ends 25A and 25B which is less than one quarter the cylindrical height of the overcap body between first and second ends 2A and 2B. A valve actuation means shown as a second recess cavity 7 is disposed coaxial with the cavity 3.

The overcap 1 functions as a standard protective overcap during shipment and shelf storage. However, in use, as shown in FIG. 2, the overcap 1 is inverted and mounted onto the aerosol can 9. Valve actuation means 7 depresses the valve stem 11 of the valve assembly. This actuation causes the product and propellant to be dispensed, as shown by arrows 15. Subsequent removal of the overcap 1 causes the valve assembly to return to a deactivated position.

As shown in FIG. 1, the overcap 1 in the valve protection position attaches to the outer rim 17 of the aerosol can 9. In this position, the overcap 1 protects the valve from accidental actuation. Inwardly extending lugs 19 spaced around the rim 20 of the overcap may be used as first attachment means. Alternatively an inwardly directed continuous lip may be used.

It should be noted that the overcap 1 may attach to other parts of the aerosol dispenser. For example the overcap 1 may attach onto an undercut in the rim 21 of the valve turret or the chime or onto the inside of the rim of the aerosol can. The overcap may also be mounted onto the outside of the rim of the mounting cup, or onto an inside crimp on the mounting cup.

In a first embodiment shown in FIG. 3, the cavity or first recess 3 of the overcap has an inner cylindrical sidewall 25 having a first and second end 25A and 25B and a shallow conical top 27 or inner base portion extending generally parallel to the annular base portion 5A. Lugs or second attachment means 29 are disposed at the first end 25A of the wall 25. Hence, as the overcap 1 is inverted and mounted on the rim 21 of the mounting cup, wall 25 flexes outwardly to enable lugs 29 to snap over the rim. In this inverted position, the overcap opens the valve and the product and propellant are dispensed.

In a second embodiment shown in FIG. 4, the cavity 3 of the overcap is configured to secure to an inside crimp 31 on the mounting cup 23. In this embodiment, there is a depending annular skirt 37 extending downwardly from dome 35. Lugs 41 are disposed on the outside of the skirt 37. In use, the skirt 37 resiliently flexes inwardly as overcap 1 is pressed down. The lugs 41 then engage crimp 31 to hold overcap 1 in an actuated position.

In a third embodiment shown in FIG. 5, the cavity 3 of the overcap fits onto the crimp 43 of the valve turret 45. A depending annular skirt 49 is disposed around the bottom edge 51 of the dome 47. Lugs 53 are disposed on the inside of the skirt 49. The skirt 49 resiliently flexes outwardly as the overcap 1 is pressed into the inverted position. The lugs 53 then engage the crimp 43 to hold the overcap 1 in an actuated position.

In a fourth embodiment shown in FIG. 6, the cavity 3 fits onto an undercut rim 55 of chime 57 of the can 9. The base of cavity 3 is shaped substantially like a celestial dome 59 with a lower edge 63 having inwardly directed lugs 65 to grasp the rim 55. Dome 59 resiliently flexes outwardly as the overcap 1 is pressed down. The lugs 65 then engage rim 55 to hold overcap 1 in an actuated position.

In a fifth embodiment shown in FIG. 7, the cavity 3 fits onto the rim 69 of the aerosol can 71. Cavity 3 has an angular-shaped dome 73 with a rim 75 grasping onto the aerosol can rim 69 through lugs 79. Rim 75 resiliently flexes outwardly as the overcap 1 is pressed down. Lugs 79 then snap over the rim to hold the overcap 1 in an actuated position.

It should be understood that the lugs utilized in all of the embodiments of the cavity may comprise a plurality of lugs or an annular protuberance. Furthermore, it should also be understood that a plurality of legs may be used instead of the skirt shown in the second, third, fourth and fifth embodiments.

The actuation means, as best seen in FIG. 3, in the first embodiment comprises a hollow nipple 83 or second cylindrical recess disposed in the base of the cup-shaped cavity 3. The cavity 87 in the nipple 83 tightly receives the valve stem 89 to form a stem sealer. The outer edge 91 of the nipple cavity 87 may be chamfered to help locate the valve stem 89. Hence, as overcap 1 is inverted and mounted on rim 21, the valve stem 89 locates in cavity 87 and depresses the valve stem 89 to open the valve. Product is dispensed through overcap nipple orifice 99.

As best shown in FIG. 8, the second embodiment of the actuation means 7 comprises a nipple 101. An orifice is dimensioned to receive an insert 105 which in turn receives the valve stem 107. Edges 109 of the nipple 101 may be chamfered.

As best shown in FIG. 9, the third embodiment of the actuation means 7 comprises an aperture 111 disposed in the base of the cup-shaped cavity 3. An enlarged valve button 113 is located in the aperture 111. Button 113 has an annular step 115. When the overcap 1 is inverted and remounted, the button 113 fits through the aperture 111. Edges 119 of the aperture 111 seated on top of the step 115 depresses the stem 117 thereby dispensing product and propellant.

As best shown in FIGS. 10, 11, 12 and 13, the fourth embodiment of the actuation means 7 comprises a cage 119 disposed over an aperture 120. In a first embodiment, the cage includes a substantially cylindrical wall 121 with a top 123 having an axial orifice 125 therein. When the overcap 1 is inverted and remounted, the valve button with or without insert 127 is enclosed in the cage 119. The top 123 of the cage 119 depresses the button 127 thereby actuating the valve assembly (not shown). Product and propellant are dispensed through terminal orifice 129 of the button with or without insert 127 and through the axial orifice 125.

The second embodiment of the cage 119 comprises at least one upstanding arm 131 shown in FIGS. 12 and 13. A hand 133 is disposed at the end of the arm 131. As the button with or without insert 135, which is rigidly press-fitted on the valve stem 136, enters cage 119, hand 133 grasps the edge 137 and depresses button 135 to dispense the product. It is noted that this particular embodiment is advantageous for use with various size valve buttons. Thus, regardless of the diameter of the button, arms 131 may flex outwardly as shown by arrow 139 but still grasp edge 137 of the button 135 to activate the valve.

As illustrated, use of the cage embodiment also enables use of a side orifice button whereby the spray is emitted horizontally. In such instance, the button has a right angle spray passage 141 therein.

From the foregoing, it should be evident that superior continuous spray overcap has been designed. The cooperative fit between the valve stem and the valve stem sealer, or between the valve button and the overcap prevents leakage therebetween. The invention also enables use of a side spray pattern as well as the use of terminal orifice inserts or buttons with inserts. Mechanical, breakup special spray or even aspirator feed flow patterns can be achieved by the overcap or button structure if desired.

It will thus been seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

Now that the invention has been described:

What is claimed is:

1. A continuous spray overcap assembly for an aerosol can having a can rim located about the upper cylindrical edge of the aerosol can and a mounting cup rim extending about the periphery of the mounting cup with a valve stem extending upwardly from the center of the mounting cup, the improvement comprising:

a one-piece cylindrical overcap body having an integral sidewall and an integral overcap base extending across a first end of said cylindrical overcap body to form a one-piece cup-shaped overcap;

a first attachment means disposed on a second end of said cylindrical overcap body for resiliently engaging the aerosol can rim when said cup-shaped overcap is in a protective position enclosing the valve stem extending from the mounting cup;

said overcap base extending inwardly from said integral sidewall and substantially perpendicular thereto forming an outer annular base portion defining an inner edge;

said overcap base including an inner cylindrical sidewall having a first and a second end and disposed parallel to said sidewall of said overcap body;

said first end of said inner cylindrical sidewall integrally attached to said inner edge of said outer annular portion with said second end of said inner cylindrical sidewall extending toward said second end of said overcap body;

said overcap base having an inner base portion disposed generally parallel to said outer annular portion and integrally extending from said second end of said inner cylindrical sidewall of defining a first substantially cylindrical recess within said overcap base coaxial with said cylindrical overcap body;

second attachment means comprising lug means integrally extending inwardly from said first end of said inner cylindrical sidewall for resiliently engaging the mounting cup rim when said cylindrical overcap body is inverted from the protective position;

said substantially cylindrical first recess having a cylindrical height being less than one quarter the cylindrical height of said cylindrical overcap body;

a second recess cavity located in said first recess cavity for receiving the valve stem therein to provide a seal with said valve stem when the overcap is inverted from the protective position;

said second recess being substantially cylindrical and extending from said first recess cavity in a direction toward said second end of said cylindrical overcap body;

an orifice disposed in said second recess cavity for fluid communication with the valve stem when the valve stem is inserted within the valve stem seal; and said recess cavities being positioned relative to said overcap base enabling said second recess cavity to depress the valve stem to continuously spray aerosol product through said orifice when said second attachment means resiliently engages the mounting cup rim.

2. A continuous spray overcap assembly for an aerosol can having a can rim located about the upper cylindrical edge of the aerosol can and a mounting cup rim extending about the periphery of the mounting cup with a valve stem extending upwardly from the center of the mounting cup, the improvement comprising:

a one-piece cylindrical overcap body having an integral sidewall and an integral overcap base extending across a first end of said cylindrical overcap body to form a one-piece cup-shaped overcap;

a first attachment means disposed on a second end of said cylindrical overcap body for resiliently engaging the aerosol can rim when said cup-shaped overcap is in a protective position enclosing the valve stem extending from the mounting cup;

said overcap base extending inwardly from said integral sidewall and substantially perpendicular thereto forming an outer annular base portion defining an inner edge;

said overcap base including an inner cylindrical sidewall having a first and a second end and disposed parallel to said sidewall of said overcap body;

said first end of said inner cylindrical sidewall integrally attached to said inner edge of said outer annular portion with said second end of said inner cylindrical sidewall extending toward said second end of said overcap body;

said overcap base having an inner base portion disposed generally parallel to said outer annular portion and integrally extending from said second end of said inner cylindrical sidewall for defining a first cylindrical recess within said overcap base coaxial with said cylindrical overcap body;

second attachment means comprising lug means integrally extending inwardly from said first end of said inner cylindrical sidewall for resiliently engaging the mounting cup rim when said cylindrical overcap body is inverted from the protective position;

said substantially cylindrical first recess having a cylindrical height being less than one quarter the cylindrical height of said cylindrical overcap body;

a second recess cavity located in said first recess cavity for receiving the valve stem therein to provide a seal with said valve stem when the overcap is inverted from the protective position;

said second recess being substantially cylindrical and extending from said first recess cavity in a direction toward said second end of said cylindrical overcap body;

an orifice disposed in said second recess cavity for fluid communication with the valve stem when the valve stem is inserted within the valve stem seal;

said second recess cavity being integrally secured to said inner base portion with said orifice comprising a through aperture in said second recess cavity coaxial with said cylindrical overcap body;

and said recess cavities being positioned relative to said overcap base enabling said second recess cavity to depress the valve stem to continuously spray aerosol product through said orifice when said second attachment means resiliently engages the mounting cup rim.

3. A continuous spray overcap assembly for an aerosol can having a can rim located about the upper cylindrical edge of the aerosol can and a mounting cup rim extending about the periphery of the mounting cup with a valve stem extending upwardly from the center of the mounting cup, the improvement comprising:

a one-piece cylindrical overcap body having an integral sidewall and an integral overcap base extending across a first end of said cylindrical overcap body to form a one-piece cup-shaped overcap;

a first attachment means disposed on a second end of said cylindrical overcap body for resiliently engaging the aerosol can rim when said cup-shaped overcap is in a protective position enclosing the valve stem extending from the mounting cup;

said overcap base extending inwardly from said integral sidewall and substantially perpendicular thereto forming an outer annular base portion defining an inner edge:

said overcap base including an inner cylindrical sidewall having a first and a second end and disposed parallel to said sidewall of said overcap body;

said first end of said inner cylindrical sidewall integrally attached to said inner edge of said outer annular portion with said second end of said inner cylindrical sidewall extending toward said second end of said overcap body;

said overcap base having an inner base portion disposed generally parallel to said outer annular portion and integrally extending from said second end of said inner cylindrical sidewall for defining a first cylindrical recess within said overcap base coaxial with said cylindrical overcap body;

second attachment means comprising lug means integrally extending inwardly from said first end of said inner cylindrical sidewall of resiliently engaging the mounting cup rim when said cylindrical overcap body is inverted from the protective position:

said substantially cylindrical first recess having a cylindrical height being less than one quarter the cylindrical height of said cylindrical overcap body;

a second recess cavity located in said first recess cavity for receiving the valve stem therein to provide a seal with said valve stem when the overcap is inverted from the protective position;

said second recess being substantially cylindrical and extending from said first recess cavity in a direction toward said second end of said cylindrical overcap body;

an orifice disposed in said second recess cavity for fluid communication with the valve stem when the valve stem is inserted within the valve stem seal;

said orifice comprising an orifice insert having an aperture and disposed in said second recess cavity for defining a fluid flow path of said orifice; and said recess cavities being positioned relative to said overcap base enabling said second recess cavity to depress the valve stem to continuously spray aerosol product through said orifice when said second attachment means resiliently engages the mounting cup rim.

* * * * *